United States Patent [19]

Koschorrek

[11] Patent Number: 4,802,941

[45] Date of Patent: Feb. 7, 1989

[54] METHOD OF MAKING WEBS, MATS AND THE LIKE OF REED-LIKE PLASTIC STRAWS FOR THATCHED ROOF

[76] Inventor: Max Koschorrek, Morzgerstrasse 38a, A-5020 Salzburg, Austria

[21] Appl. No.: 34,706

[22] Filed: Apr. 6, 1987

[30] Foreign Application Priority Data

Sep. 11, 1986 [AT] Austria ..... 2445/86

[51] Int. Cl.[4] ..... E04D 9/00

[52] U.S. Cl. ..... 156/244.18; 52/750; 156/302; 156/269; 156/271

[58] Field of Search ..... 52/750, 518, 555; 156/302, 244.11, 244.18, 244.19, 269, 271; 198/456, 457; 53/591; 265/152, 159

[56] References Cited

U.S. PATENT DOCUMENTS

| | | | |
|---|---|---|---|
| 3,315,436 | 4/1967 | Baum et al. | 156/302 X |
| 3,802,987 | 4/1974 | Noll | 53/591 X |
| 4,140,825 | 2/1979 | Koschorrek | 156/72 X |
| 4,611,451 | 9/1986 | Symbold | 52/750 X |

FOREIGN PATENT DOCUMENTS

| | | | |
|---|---|---|---|
| 2446541 | 4/1974 | Fed. Rep. of Germany | 52/750 |
| 2344961 | 3/1975 | Fed. Rep. of Germany | 52/750 |
| 1002620 | 8/1965 | United Kingdom | 52/750 |

*Primary Examiner*—David Simmons
*Assistant Examiner*—Jeff H. Altergut
*Attorney, Agent, or Firm*—Karl F. Milde, Jr.

[57] ABSTRACT

The invention relates to a method and an apparatus for making webs, mats and the like of reed-like plastic straws (H), by which straw chains (K) of parallel, adjacent straws of unequal length are applied like scales on a support sheet (13). To achieve a fully automated manufacturing process, straws (H1) of equal length are first produced and arranged side by side, in parallel, to form a row (R). They are then attached together along their aligned ends and preferably also, along at least one longitudinal line dividing the row of straws widthwise, with adhesive tape (8) extending in the lengthwise direction of the row. Thereafter, if desired, the straw row (R) is cut into partial rows (T) along the longitudinal lines covered by tape. Then, by a segmentwise severing of the straws, the straw row (R) is, or respectively the partial rows (T) are, split apart with varying ratios of division into a pair of individual straw chains (K) forming, on the one hand, a straight edge (K1) with the straw ends held together by the adhesive tape (8) and, on the other hand, a jagged edge (K2) formed from the free straw segment ends which have been severed. These straw chains (K) are subsequently ordered longitudinally in parallel so that their jagged edges (K2) overlap their straight edges (K1), and they are affixed (e.g. sewn) to a support sheet (13) along their straight edges (K1).

15 Claims, 4 Drawing Sheets

METHOD OF MAKING WEBS, MATS AND THE LIKE OF REED-LIKE PLASTIC STRAWS FOR THATCHED ROOF

BACKGROUND OF THE INVENTION

The invention relates to a method and apparatus for making webs, mats and the like of reed-like plastic straws, wherein straw chains formed of adjacent, parallel plastic straws of unequal length are affixed like scales to a support sheet or backing. The invention also relates to the webs, mats and the like produced by this method and apparatus.

Webs or mats of plastic straws, as disclosed for example in the Austrian Pat. No. 312,225, provide excellent covering material for roofs because of their heat and sound insulating properties, their waterproof properties, their weather resistance and, last but not least, because of their visual impression as a "thatched roof". Such webs or mats are also suitable as facing and filling material for building fronts, for camouflage or for souddproof walls. However, the straw webs or mats could, until now, be produced only in a time-consuming and labor-intensive manner since the plastic straws had to be arranged by hand on a support sheet and then welded or glued together in sections.

This manner of production results in individual mats of relatively large area which are difficult to lay, which are expensive because of their uneconomical manufacture, and which represent an unsatisfactory imitation of natural reed products.

SUMMARY OF THE INVENTION

It is, therefore, an objective of the present invention to eliminate these shortcomings and to provide a method which permits the efficient, fully automated manufacture of reed-like plastic straw webs, mats and the like that can be handled and mounted skillfully and that convey the impression of natural reed material. It is, moreover, an objective of the invention to provide a simple and appropriate apparatus for carrying out this method. Finally, it is an objective of the invention to provide a web, mat or the like which is produced by the method and apparatus according to the invention and which can be easily and speedily mounted on and attached to a roof or the like in such a way as to simulate a genuine "thatched roof."

These objectives, as well as other objectives of the present invention which will become apparent from the discussion that follows, are achieved, according to the invention, by a method comprising the steps of:

(a) arranging side by side and holding together in parallel a plurality of reed-like plastic straws of equal length, thereby forming a row of straws;

(b) severing the straws along at least one longitudinal axis of the row, with a varying ratio of division, thereby forming at least two straw chains having a straight edge on one side with the straw ends aligned together and a jagged edge on the opposite side with the severed straw ends unaligned;

(c) ordering the straw chains in adjacent, parallel relationship such that their straight edges are substantially parallel and are spaced apart a distance which is less than the width of the straw; and (d) affixing the straw chains to a support sheet such that the straw chains overlap with their jagged edges exposed.

According to this method, webs or mats formed of reed-like, easy to manufacture plastic straws of any contour and color are fabricated continuously, and without any manual intervention, from the initial row-formation to the final assembly of the finished product.

From one straw row are formed at least two, and preferably six straw chains, which are advantageously held together by adhesive tape along one edge and are easily attached continuously on the support sheet, e.g., by sewing. The severing of the straw row or of the partial rows, varying in ratio from straw to straw, not only permits making two straw chains from each row, but also provides the desired irregularity of the free straw ends of each chain which is a prerequisite for the impression of a natural reed product. An overlap of the straw chains adapted to the size range of these irregularities then blurs the rows formed by the successive straw chains so that the finished web or mat has a perfectly natural reed character.

This continuously produced web is adjustable in its width, depending upon the number of straw chains sewn on. It can be stored in rolls and cut to any desired length of strips or mats. The web can be produced in practically any format and therefore is adaptable to the particular purpose of use, type of laying, etc.

Since after severing of the straw rows or partial rows, straw chains are formed with mutually facing jagged edges and with smooth edges turned away from each other, these straw chains must be placed in proper order for final sewing onto the support sheet. This is accomplished, according to a particular feature of the invention, by (1) setting the straw chains on edge or upright with their straight edges down, in mutually parallel paths; (2) bringing them adjacent to each other but spaced apart the mutual distance required for overlap; and thereafter (3) depositing them co-directionally on the support sheet at longitudinally staggered positions, in preparation for sewing or welding them on. By arranging the straw chains upright, they may be easily aligned and spaced apart the desired row distance for application on the support sheet. The subsequent co-directional deposit of the straw chains onto the support sheet then automatically results in the scale-like arrangement with the desired overlap. By staggering this deposit from chain to chain, space is gained for the respective sewing or welding of the individual straw chains on to the support sheet.

In a favorable arrangement, according to the invention, the straw chains are deflected, after setting them on edge, along staggered arcs curved around straw-parallel axes. This deflection achieves not only the desired mutual spacing of the straw chains but also, since the straw chains are displaced relative to each other in the lengthwise direction, it avoids a match or synchronization of the jagged edges in the overlapping sewing of the straw chains on the support sheet. This prevents any visually perceptible "row effect" on the finished straw web or mat.

After sewing or welding, the seams are preferably covered with a permanent plastic cover tape, such tape providing reliable protection against the penetration of rain or similar splash water. The cover tape closes the sewing holes (if present) on the top side of the straws and additionally secures the stitch points which are covered, in any case, by the next straw chain. The holes present on the underside of the straws and in the support sheet remain open, however, permitting the diffusion of vapor and hence allowing the straw web to "breathe".

To give the reed (straw) web a truly natural appearance, the jagged edges (plastic straw ends) can further be split open after the straw chains have been affixed to the support sheet, so as to create the impression of "worked" reeds.

According to an especially advantageous embodiment of the invention, a large number of straws are extruded simultaneously and in parallel, and then jointly cut to size. Thereafter, the cut straws are strung together in a direction perpendicular to the direction of extrusion. It is thereby possible to let the row formation of straws follow directly after their production and, starting with the extrusion of the plastic straws, to manufacture straw webs or mats, ready for laying, in a continuous operation.

Apparatus, according to the present invention, suitable for carrying out the method described above includes a conveyor for the straws strung together which leads, via a gluing and cutting station, to a sewing or welding station. The gluing and cutting station comprises a pair of endless clamping belts or the like for receiving and clamping the straws between them. Preceding the clamping belts is an adhesive tape pull-off device with adhesive tapes extending in the marginal regions and also preferably in the regions of at least one subdivision of the straws which are to be drawn in between the clamping belts. If desired, a circular cutting blade may be is provided in the clamping region of the clamping belts for lengthwise cutting along the central adhesive tapes. An automated punching device with at least one punching tool is provided between the adhesive tapes to create the jagged straw edges. Finally, the apparatus includes a sewing station consisting of a sewing or welding table, which follows an unwinding device for a supply roll of the support sheet and has at least two sewing or welding machines, relatively offset with respect to each other.

The plastic straws, which are loosely strung together after extrusion and cutting, are initially clamped by the clamping belts, with the simultaneous application of the adhesive tapes, and are conveyed to the longitudinal cutting and subsequent stamping device, respectively. With the longitudinal cutting device the straw row, already held together by the adhesive tapes, is cut into at least two, and preferably three partial rows, so that several straw chains are then formed simultaneously from the straw row by the subsequent stamping device. The stamping or severing of the straws results in an uneven or variable amount of breakage of the straws, so that the free ends of the divided straw segments will have a very natural appearance. This desired irregularity of the straw segments is achieved by varying the attack or contact position or altitude of the stamping tools. At a speed corresponding to that of the clamping belts, the individual straw chains are moved continuously into the sewing or welding station, where they are sewn or welded onto the support sheet which is supplied at the same speed, a stagger of the sewing or welding machines ensuring an unimpeded sewing or welding operation.

In an advantageous development of the invention, the stamping device comprises at least one tool carrier, guided in lengthwise direction of the straws and movable by means of a microprocessor-controlled stepper motor, which holds the stamping tools that include and are actuated via a piston-cylinder drive unit. This tool carriage brings the stamping tool into a different position for each stamping step according to a program run in the microprocessor so that the straws are severed with the irregularity required for the visual impression of a thatched roof. The preferably pneumatic piston-cylinder unit for the stamping tool further makes possible a rapid stamping cut, thus permitting the continuous severing of the straws during their advance.

If at least two tool carriages with stamping tools are arranged one behind the other lengthwise of the rows, each having its own stepper motor, several stamping tools will be available for severing the straw rows so that (1) the speed of the division into straw chains can be increased, and (2) there are more possibilities for variation of the positions of the stamping tools. The stamping positions of all tool carriages can be preset by a single microprocessor, which then controls each of the stepper motors.

In order to seal the seams immediately after the sewing (or welding) operation, the sewing (or welding) machines are followed by cover tape dispensers with press-on rollers running over the seams, so that a cover tape is applied to each respective seam before the straw chain overlapping this seam is placed over it.

It is further desirable if, according to the invention, the conveyor has at least two straw guides after the gluing and cutting station which consist of guide walls changing over in the direction of transport from a horizontal to a vertical position, and then extending, staggered fashion, along quarter arcs and subsequently again changing from the vertical to the horizontal position. These straw guides serve to set the straw chains on edge during their lengthwise transport and, in accordance with the arc, stagger their mutual relative displacement. Thereafter, these guides bring the straw chains together with the proper spacing, laying them stepwise onto the support sheet for the sewing or welding operation.

The sewing or welding station is preferably followed by a cleaving station, provided with cleaving rolls with radial beaters rotated and driven about longitudinal axes which extend in the feed direction of the web. The free straw ends of the finished straw web are thereby splintered and the straw web assumes a very natural reed-like appearance.

According to an especially advantageous embodiment of the invention, the gluing and cutting station is preceded by a straw chute with rotating brush rollers arranged above it. The straws, cut to equal length, are placed loosely on the straw chute and are automatically strung together by the brush rollers to form a corresponding straw row.

If an extruder is used for the plastic straw production, this extruder preferably comprises a multiple die with a plurality of parallel nozzles and a belt pull-off device that extends in width over the entire die region. The belt pull-off device includes of a conveyor belt pair followed by a cross-cutting station with a cutting carrier equipped with cutter bars that is movable above the straw chute in the lengthwise direction of the straws, counter to the force of a restoring spring. The extruded straws are drawn off uniformly from the extruding die and then jointly cut to length in the cross-cutting station by the cutting carriage. The severed straw segments drop onto the straw chute which transports them and strings them together as a row.

The cutting carriage is movable so as to be able to travel along, during cutting, with the continuously extruded straws, thus not impairing the extrusion. The plural, extruded straws are cut to length in groups and thereafter fed to the continuous straw row to be further fabricated in a continuous process thereby achieving high production speeds.

A web or mat produced by the method and apparatus according to the present invention can have any desired width or length. A preferred embodiment of a web, which is particularly convenient to store, transport and eventually install on a roof or wall, is approximately 35 centimeters wide and 6 meters long. Spirally wound rolls of this length may be easily carried by one man, and 6 m strips may be layed and tacked into place by one or two persons with a minimum of training.

Alternatively, additional straw chains may be superimposed, in scale-like fashion, on the support sheet so that the width of the web or mat will be greater than 35 centimeters. Also, the web may be cut into individual mats of, say, 1 meter in length or manufactured and stored in strips which are longer than 6 meters.

According to a particular, preferred feature of the present invention, the ends of the webs or mats are designed to "dovetail" together to eliminate the possible appearance of a seam or edge. In the preferred embodiment, the ends of the support sheet are cut at a slant, preferably at about 45°. The ends of the straw chains are similarly cut in staggered fashion to follow the slanted edge of the support sheet.

Preferably, the ends of the straw chains are also cut so as to be indented with respect to the support sheet on one end of the web and to protrude from the other. In this way, successive webs may be installed, end to end, with the ends of successive support sheets abutting each other beneath the running straw chains. This provides additional protection against the penetration of moisture at the critical ends of a web or mat.

For a full understanding of the present invention, reference should now be made to the following detailed description of the preferred embodiments of the invention and to the accompanying drawings.

DESCRIPTION OF THE PREFERRED EMBODIMENTS

Figure 1:
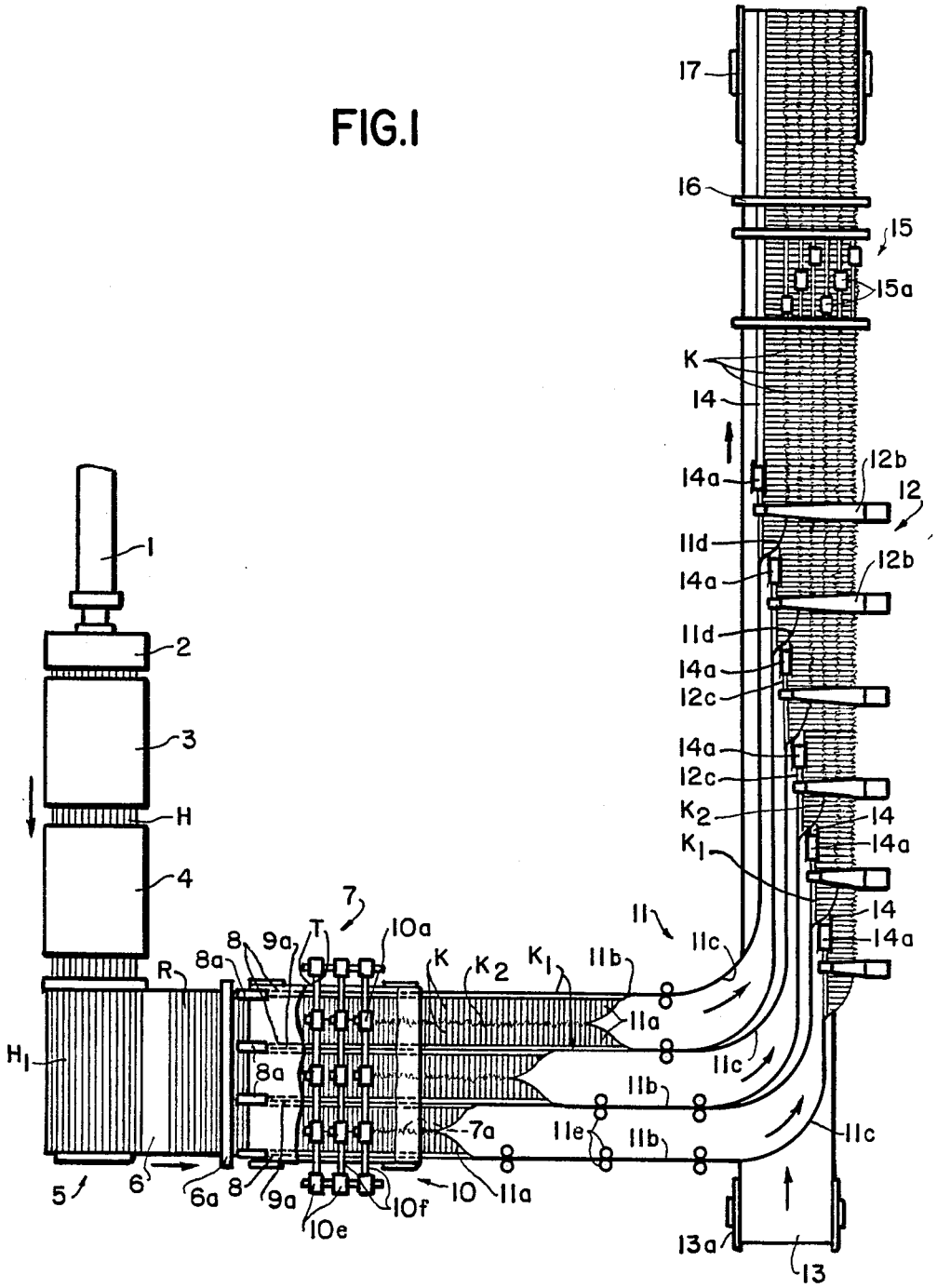
FIG. 1 is representational diagram, in top view, of complete apparatus, according to the present invention, for fabricating a web of reed-like plastic straws.
Figure 2:
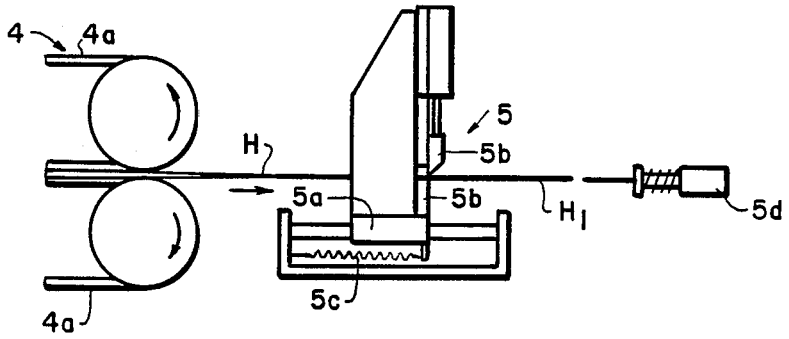
FIG. 2 is a representational diagram, in side view, of a first portion of the apparatus of FIG. 1, for cutting groups of extruded plastic straws.

The preferred embodiments of the present invention will now be described with reference to FIGS. 1–9 of the drawings. Identical elements in the various figures are designated with the same reference numerals.

The apparatus illustrated in the drawings permits the manufacture of webs, mats and the like of reed-like plastic straws in a continuous operation from the individual, plastic straw production to the straw web ready for laying or cutting and rolled up for storage. The apparatus comprises an extruder 1 with a multiple die 2 which permits the simultaneous extrusion of a plurality of parallel plastic straws H. After extrusion through the multiple die 2 the straws are passed through a cooling and calibrating section 3. A subsequent belt conveyor 4, consisting of a pair of revolving conveyor belts **4*a* (FIG. 2), uniformly pulls the straws off the cooling section and feeds them to a cross-cutting station 5**, in which they are jointly cut to length.

The cross-cutting station 5 consists of a cutting carriage **5*a* (FIG. 2) which is guided lengthwise of the straws, carries cutter bars 5*b*, and is movable counter to the force of a restoring spring 5*c*. The cutter bars 5*b* are actuated by a limit switch 5*d*, the carriage 5*a* being moved along while cutting through the straws H supplied at the rate of extrusion, thus facilitating a smooth, even cut. After the cut, the cutter bars 5*b* open and the restoring spring 5*c* brings the cutting carriage 5*a* back to the starting position. The cut-off straw segments H1 fall in groups onto a chute 6 that commences beneath the cross-cutting device, and as soon as the ends of the straws H, which are further continuously extruded, again touch the limit switch 5*d***, the next cutting operation takes place.

Figure 3:
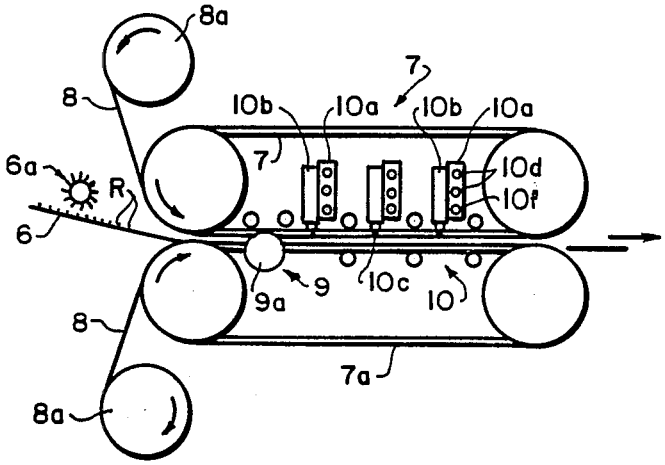
FIG. 3 is a representational diagram, in side view, of a second portion of the apparatus of FIG. 1 for producing jagged edges on rows of plastic straws ("straw chains").

The straws falling off in groups onto the straw chute 6 are arranged side by side in a row R of the individual straw segments H1 of equal length. Brush rollers **6*a* (FIG. 3) provide for the orderly arrangement of the successive individual straws to form an even, continuous row. The chute 6 leads to a clamping and cutting section 7, through which the straw row R is transported via a pair of endless clamping belts 7*a* (FIG. 3). The straws in the straw row R are attached together with adhesive tape 8 in the marginal regions and in two intermediate regions, thus dividing the straw row longitudinally into thirds. For this purpose the clamping belts 7*a* are preceded by adhesive tape supply rolls 8*a*, from which the adhesive tape 8 is pulled in between the clamping belts 7*a* and thereby pressed and affixed onto the straw row R. A subsequent lengthwise cutting device 9, with two circular cutters 9*a* (FIG. 3) oriented to cut the central adhesive tape strips 8, cuts the straw row R longitudinally along the center lines of the central adhesive tape strips into three partial rows T that then pass through a stamping device 10** in which each partial row T is divided into two straw chains K.

The stamping device 10 comprises for each partial row T three tool carriages **10*a* arranged one behind the other with stamping tools 10*c* actuated by hydraulic piston-cylinder units 10*b* (FIG. 3). The tool carriages 10*a* are movable crosswise with respect to the straw rows T along linear guides 10*d* by stepper motors 10*e* and spindles 10*f*. The stepper motors 10*e* are controlled, e.g. by programmed microprocessors, to bring the tool carriages 10*a*, after each stamping cut, into a changed stamping position, so that by the successive stamping tools 10c the partial rows T are severed irregularly from straw to straw. There results, therefore, six straw chains K, each comprising a smooth edge K1, provided with an adhesive tape strip 8 and a jagged edge K2** formed by (cutting) stamping the free straw segment ends to different lengths.

After the cutting station 7 the six straw chains K are handled by straw guides 11 and brought to a subsequent sewing station 12. The straw guides 11 form guide walls for each chain K which, in the transport direction, change the orientation of the chains K from a horizontal section 11a to a vertical section 11b, and then, staggered from guide to guide, curve along a 90° arc 11c, and finally terminate again in a horizontal section 11d. The straw guides 11 are provided with transport rollers 11e so that the straw chains K are uniformly set on edge, then brought to a certain distance from one another by the arcuate deflection and longitudinally offset. As a result, the straw chains K, when placed down co-directionally in a sewing station 12, overlap like scales with their jagged edges K2 displaced to avoid "row effects".

Figure 4:
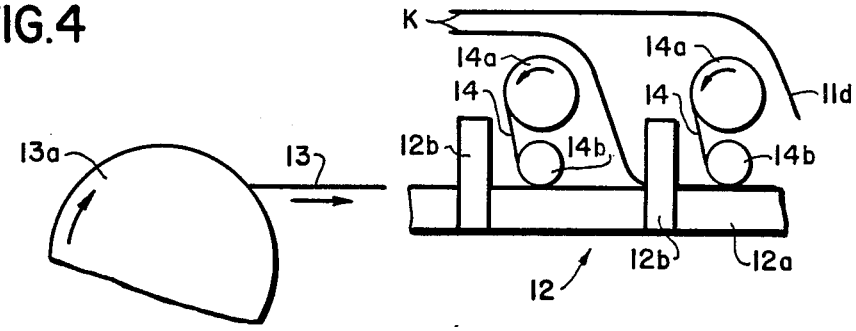
FIG. 4 is a representational diagram, in side view, of a third portion of the apparatus of FIG. 1 for applying and sewing (or welding) straw chains onto a support sheet.

The sewing station 12 consists of a sewing table 12a (FIG. 4) and a plurality of sewing machines 12b, suitable for sewing the straw chains K, which are offset relative to each other in accordance with the spacing of the overlapping straw chains K. To supply a support sheet 13, an unwinding device 13a is provided ahead of the sewing table 12a. The straw chains K are sewn onto the support sheet 13 so as to lie like fish scales, one over the other. The straw chains K move over the straw guides 11, at the staggered end sections lld thereof spaced one behind the other, onto the support sheet 13, so that, between the regions where the chains K are applied, there remains room for arrangement of the sewing machines 12b. The chains K are sewn on along their smooth edges K1, the seams 12c being covered up by plastic cover tape 14 to seal the stitch holes. For this purpose, the sewing machines 12b are each followed by a cover tape dispenser 14a and a press-on roller 14b (FIG. 4).

As an alternative to sewing, it is possible to replace the sewing machines with machines which operate continuously to weld the smooth edges K1 of the chains K to the support sheet 13. In this case, the support sheet should be provided with a plastic top layer which is weldable to the plastic straws.

After the sewing (or welding) station 12, there is provided a support sheet 13 covered with six scale-like layers of straw chains K, all of which create the impression of a natural reed web. To further improve this natural appearance, there may also be provided a cleaving station 15, in which cleaving rolls 15a (FIG. 5), rotating about axes lying in the feed direction of the web and having beaters 15b hanging on ropes or the like, splinter the jagged edges K1.

The reed web thus completed can then be passed through a cutting device 16 and wrapped by means of a winding device around a roll core 17. When a roll is completely full, the web is cut and the roll is replaced, on the fly, with a new take-up roll core. The completed rolls are easily transportable, conveniently stored, and immediately suitable for further processing.

Figure 6:
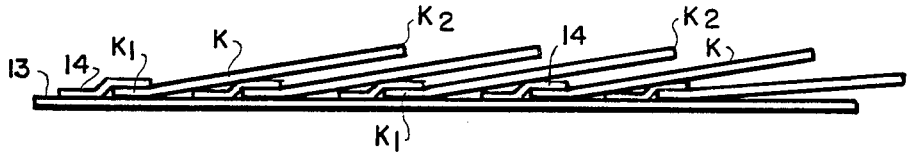
FIG. 6 is an end view of a reed-like plastic straw web, manufactured by the apparatus of FIG. 1.

FIG. 6 shows, in side view, the construction of a finished web. As may be seen, the web includes a support sheet 13 made of weatherproof material and a number (e.g., 6) of straw chains K which are sewn (or welded) to the support sheet. Weatherproof cover tape 14 covers the smooth edges Kl of the straw chains K including the sewing stitches (if any).

The web, so produced by the method and apparatus of the present invention, is stored in long (e.g., 50 meter) lengths on the roll cores 17. Prior to supplying this material in commerce to end users for installation on rooves, walls and the like, the web must be severed into shorter, convenient lengths which are suitable for handling. When cutting to length, opposite ends of the web are preferably cut in the manner illustrated in FIGS. 7 and 8 so that these ends "dovetail" together on installation to eliminate the possible appearance of a seam or edge. Preferably, the ends of the straw chains are also cut so as to be indented with respect to the support sheet on one end of the web and to protrude from the other. The support sheet 13 itself is preferably cut at a slant, for example at 45°, and the ends of the straw chains are cut in staggered fashion, as shown, to follow the slanted edge of the support sheet.

Figure 7:
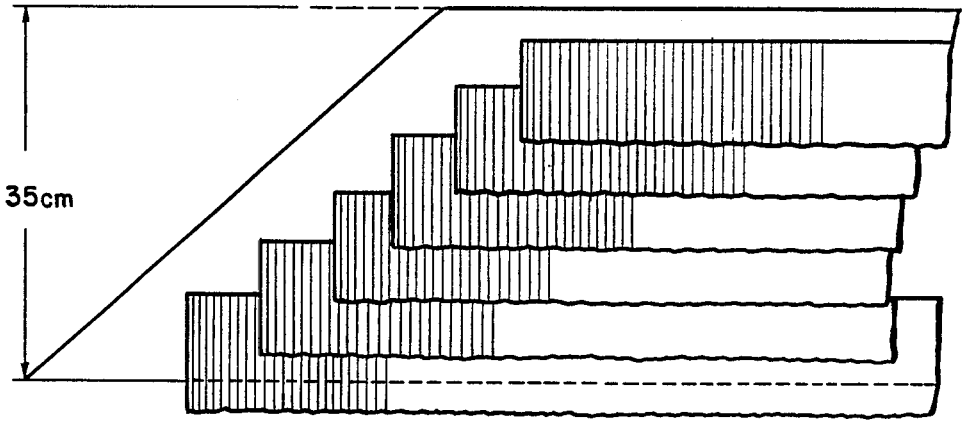
FIG. 7 is a plan view of one end of a reed-like plastic straw web, manufactured by the apparatus of FIG. 1.
Figure 8:
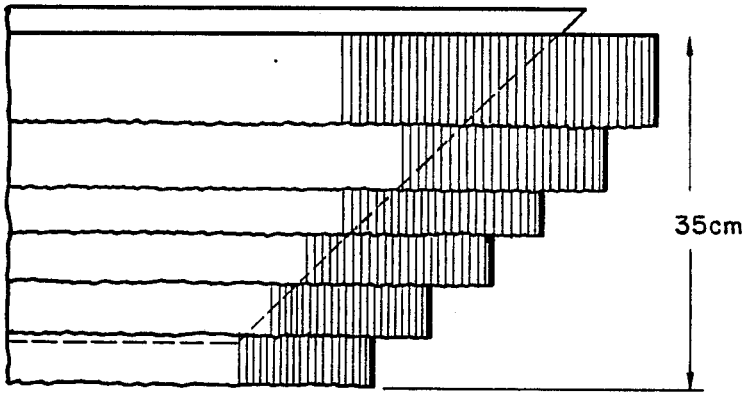
FIG. 8 is a plan view of the opposite end of a reed-like plastic straw web, manufactured by the apparatus of FIG. 1.
Figure 5:
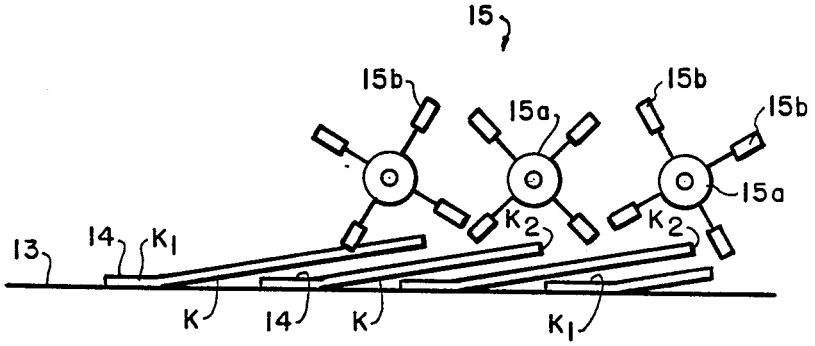
FIG. 5 is a representational diagram, in end view, of a forth portion of the apparatus of FIG. 1 for splintering the jagged edges (ends) of the plastic straws.
Figure 9:
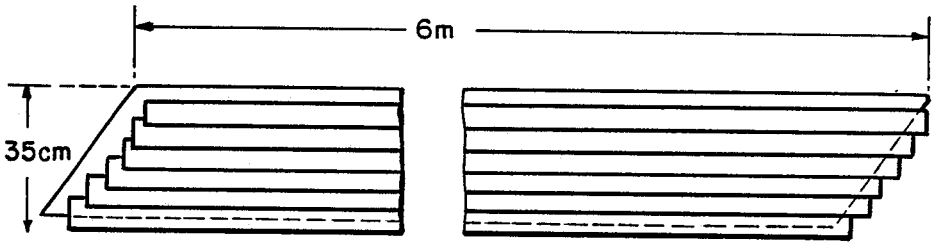
FIG. 9 is a plan view of a reed-like plastic straw web, manufactured by the apparatus of FIG. 1.

FIG. 9 shows a completed web of reed-like plastic straws cut to a convenient size for installation in the field. As is also indicated in FIG. 7, the support sheet 13 of the web is 35 centimeters wide. The ends of the web are cut in the manner shown in FIGS. 7 and 8 such that the support sheet is 6 meters in length. It will be understood that the web may be cut to smaller lengths, such as 1 meter, to form mats, or cut to longer lengths, such as 10 meters, to form longer strips, as desired.

There has thus been shown and described a novel method and apparatus for making webs or mats of reed-like plastic straws, as well as webs or mats made by this method and apparatus, which fulfill all the objects and advantages sought therefor. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only the claims which follow.

What is claimed is:

1. A method of making webs, mats and the like of reed-like plastic straws in a continuous automated fashion, whereby straw chains formed of straws of unequal length, arranged side by side and substantially in parallel, are affixed in an overlapping, scale-like manner to an elongated support sheet, said method comprising the steps of:

(a) arranging side by side and in parallel a plurality of plastic straws of equal lengths thereby forming a row of straws;

(b) severing said straws along at least one longitudinal axis of said row, with a varying ratio of division with a stamping tool automatically controlled to move transversely to said at least one longitudinal axis of said row thereby to form at least two straw chains having a straight edge on one side with the straw ends aligned together and a jagged edge on the opposite side with the severed straw ends unaligned;

(c) ordering said straw chains in adjacent, parallel relationship such that their straight edges are substantially parallel and are spaced apart a distance which is less than the width of said chains; and (d) affixing said straw chains to a support sheet such that said straw chains overlap with their free jagged edges exposed.

2. The method defined in claim 1, further comprising the step of applying adhesive tape longitudinally to said row of straws, thereby to hold said straws together.

3. The method defined in claim 2, wherein said adhesive tape is applied to the edges of said straws prior to severing said straws with a varying ratio of division.

4. The method defined in claim 3, further comprising the step of applying adhesive tape to said row of straws along at least one longitudinal line intermediate said ends.

5. The method defined in claim 4, further comprising the step of cutting said row of straws along said at least one longitudinal line, thereby to form at least two partial rows of straws, and wherein said severing step includes the step of severing each partial row into two straw chains, thereby forming, for each chain, a straight edge of the straw ends held together by said adhesive tape and a jagged edge of free straw ends which have been severed.

6. The method defined in claim 1, wherein said affixing step includes the step of sewing said straw chains onto said support sheet.

7. The method defined in claim 1, wherein said affixing step includes the step of welding said straw chains onto said support sheet.

8. The method defined in claim 1, wherein said ordering step includes the step of orienting said straw chains substantially vertically with their straight edges on the bottom and depositing said straw chains codirectionally on said support sheet in overlapping, parallel relationship.

9. The method defined in claim 8, further comprising the step of moving said straw chains substantially in parallel, after they have been oriented substantially vertically, along staggered arcs which are curved around straw-parallel axes, thereby to displace the straw chains with respect to each other prior to depositing them on said support sheet.

10. The method defined in claim 1, further comprising the step of continuously moving said support sheet substantially horizontally and wherein said straw chains are deposited on said horizontally moving support sheet.

11. The method defined in claim 1, wherein said straw chains are affixed to said support sheet adjacent their straight edges.

12. The method defined in claim 11, further comprising the step of covering the straight edge of each respective straw chain with a protective tape after such straw chain has been affixed to said support sheet.

13. The method defined in claim 12, wherein said protective tape overlaps both said support sheet and the straight edge of each straw chain, thereby covering said straight edges.

14. The method defined in claim 1, further comprising the step of splintering said jagged edges after said straw chains have been affixed to said support sheet.

15. The method defined in claim 1, further comprising the step of simultaneously extruding a plurality of plastic straws in parallel and periodically cutting the extruded straws jointly to length, whereby said row of straws arranged in step (a) extends in a direction perpendicular to the direction of extrusion.

* * * * *